US010335334B2

(12) United States Patent
Seim

(10) Patent No.: US 10,335,334 B2
(45) Date of Patent: Jul. 2, 2019

(54) EMERGENT SITUATION NOTIFICATION DURING TRANSPORT OF A PATIENT SUPPORT APPARATUS

(71) Applicant: Hill-Rom Services, Inc., Batesville, IN (US)

(72) Inventor: Douglas A. Seim, Okeana, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 15/949,130

(22) Filed: Apr. 10, 2018

(65) Prior Publication Data

US 2018/0296415 A1 Oct. 18, 2018

Related U.S. Application Data

(60) Provisional application No. 62/485,509, filed on Apr. 14, 2017.

(51) Int. Cl.

| | |
|---|---|
| ***A61G 7/05*** | (2006.01) |
| ***G08B 21/18*** | (2006.01) |
| ***G08B 25/01*** | (2006.01) |

(52) U.S. Cl.

CPC ..... *A61G 7/0524* (2016.11); *G08B 21/18* (2013.01); *G08B 25/016* (2013.01); *A61G 2203/20* (2013.01); *A61G 2203/30* (2013.01); *A61G 2205/60* (2013.01)

(58) Field of Classification Search

CPC ... A61G 7/0524; A61G 2203/20; G08B 21/18
See application file for complete search history.

(56) References Cited

U.S. PATENT DOCUMENTS

| | | | | |
|---|---|---|---|---|
| 6,014,346 | A | 1/2000 | Malone | |
| 6,344,794 | B1 | 2/2002 | Ulrich et al. | |
| 7,319,386 | B2 | 1/2008 | Collins, Jr. et al. | |
| 7,520,006 | B2 | 4/2009 | Menkedick et al. | |
| 7,831,447 | B2 | 11/2010 | Schuman | |
| 9,220,650 | B2 | 12/2015 | Bobey et al. | |
| 2002/0165733 | A1 | 11/2002 | Pulkkinen et al. | |
| 2005/0151641 | A1 | 7/2005 | Ulrich et al. | |
| 2006/0049936 | A1* | 3/2006 | Collins, Jr. ..... | A61B 5/1115 340/539.11 |
| 2007/0139190 | A1 | 6/2007 | Tanner et al. | |
| 2013/0048705 | A1* | 2/2013 | Tallent ..... | G06Q 10/06 235/375 |
| 2014/0221764 | A1 | 8/2014 | Pittenger et al. | |
| 2016/0140307 | A1* | 5/2016 | Brosnan ..... | G06F 19/3406 600/324 |

* cited by examiner

*Primary Examiner* — Nabil H Syed
(74) *Attorney, Agent, or Firm* — Barnes & Thornburg LLP

(57) ABSTRACT

A patient-support status system includes a patient support apparatus adapted to support a patient thereon. A user interface is coupled to the patient support apparatus to move therewith and configured to receive a user input associated with a status of the patient. A location-detection system is configured to provide location data associated with a location of the patient support apparatus in a healthcare facility. A communication unit is coupled to the patient support apparatus and configured to communicate the status and the location data to a remote computer in response to receipt of the user input.

30 Claims, 5 Drawing Sheets

EMERGENT SITUATION NOTIFICATION DURING TRANSPORT OF A PATIENT SUPPORT APPARATUS

PRIORITY CLAIM

This application claims priority under 35 U.S.C. § 119(e) to U.S. Provisional Application No. 62/485,509, filed Apr. 14, 2017, which is expressly incorporated by reference herein.

BACKGROUND

The present disclosure relates to a patient support apparatus, and in particular, to a patient support apparatus configured to communicate information from the patient support apparatus to a remote system. More particularly, the present disclosure relates to a notification system configured to receive a location of the patient support apparatus and information from the patient support apparatus and communicate the information and location to the remote system.

Healthcare facilities may include a call system which may be used to communicate caregiver need or patient status. Patients or caregivers place calls by pressing a caregiver call button located on the patient support apparatus, a handheld unit, or by actuating a wall mounted switch. Call systems are coupled to a stationary source of power (e.g., a wall electric socket) and a stationary data link (e.g., a network port) in order to function. In the example where the call system is located on the patient support apparatus, the call system loses functionality when the patient support apparatus is unplugged from electrical power and data connectivity. As a result, call systems are not available to caregivers or patients when the patient support apparatus is moved in the healthcare facility should an emergency occur.

In an emergency situation during transportation, the transporting caregiver must search for the nearest qualified caregiver to assist the patient in his/her current emergent state. In the case of an emergency call, the exact location of the patient may be unknown to the individuals responding and the systems that generate the alarm. This may lead to confusion and an extended response time by emergency responders.

SUMMARY

The present application discloses one or more of the features recited in the appended claims and/or the following features which, alone or in any combination, may comprise patentable subject matter.

In a first aspect of the present disclosure, a patient-support status system includes a patient support apparatus adapted to support a patient thereon. A user interface is coupled to the patient support apparatus to move therewith and configured to receive a user input associated with a status of the patient. A location-detection system is configured to provide location data associated with a location of the patient support apparatus in a healthcare facility. A communication unit is coupled to the patient support apparatus and configured to communicate the status and the location data to a remote computer in response to receipt of the user input.

In some embodiments, a battery is coupled to the patient support apparatus and configured to power the user interface, location detection system, and communication unit. In some embodiments, the communication unit is configured to communicate patient identification information to the remote computer. In some embodiments, the communication unit communicates through a radio frequency (RF) transmission. In some embodiments, the communication unit communicates through an infrared (IR) transmission. In some embodiments, the communication unit communicates through a wireless transmission. In some embodiments, the user interface is located on a siderail of the patient support apparatus. In some embodiments, the communication unit is configured to communicate the status and the location data to the remote computer via a waypoint. In some embodiments, the communication unit is configured to receive alert data from the remote computer, the alert data displayed on the user interface. In some embodiments, the alert data includes at least one of healthcare facility data, healthcare facility personnel data, or patient data.

In a second aspect of the present disclosure, a method of communicating a location of a patient-support apparatus includes receiving a user input associated with a status of the patient at a user interface coupled to the patient support apparatus and moving therewith. The method also includes providing location data associated with a location of the patient support apparatus in a healthcare facility with a location-detection system. The method also includes communicating, with a communication unit coupled to the patient support apparatus, the status and the location data to a remote computer in response to receipt of the user input.

In some embodiments, the method also includes powering the user interface, location detection system, and communication unit with a battery coupled to the patient support apparatus. In some embodiments, the method also includes communicating patient identification information to the remote computer. In some embodiments, the method also includes communicating through a radio frequency (RF) transmission. In some embodiments, the method also includes communicating through an infrared (IR) transmission. In some embodiments, the method also includes communicating through a wireless transmission. In some embodiments, the method also includes communicating the status and the location data to the remote computer via a waypoint. In some embodiments, the method also includes receiving, at the communication unit, alert data from the remote computer. In some embodiments, the method also includes displaying the alert data on the user interface. In some embodiments, the alert data includes at least one of healthcare facility data, healthcare facility personnel data, or patient data.

In a third aspect of the present disclosure, a healthcare facility location communication system includes a remote computer located in a healthcare facility for monitoring a patient status. A patient support apparatus is adapted to support the patient thereon. The patient support apparatus includes a user interface to receive a user input associated with a status of the patient. A location-detection system is configured to provide location data associated with a location of the patient support apparatus in the healthcare facility. A communication unit is configured to communicate the status and the location data to a remote computer in response to receipt of the user input.

In some embodiments, the a patient support apparatus includes a battery coupled to the patient support apparatus and configured to power the user interface, location detection system, and communication unit. In some embodiments, the communication unit is configured to communicate patient identification information to the remote computer. In some embodiments, the communication unit communicates through a radio frequency (RF) transmission. In some embodiments, the communication unit communicates through an infrared (IR) transmission. In some embodiments, the communication unit communicates through a wireless transmission. In some embodiments, the user interface is located on a siderail of the patient support apparatus. In some embodiments, the system includes a waypoint. The communication unit is configured to communicate the status and the location data to the remote computer via the waypoint. In some embodiments, the communication unit is configured to receive alert data from the remote computer, the alert data displayed on the user interface. In some embodiments, the alert data includes at least one of healthcare facility data, healthcare facility personnel data, or patient data.

Additional features, which alone or in combination with any other feature(s), such as those listed above and/or those listed in the claims, can comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION

A patient may be moved multiple times in a healthcare facility from one room to another during their stay. The patient may be moved on a patient support apparatus. During those moves, the patient may have a medical emergency that may require assistance from a caregiver or medical equipment that is not in the vicinity at the time of the emergency. A patient-support status system in accordance with the present disclosure allows a location and alarm state of a patient support apparatus 10 in transport to be communicated to a remote location so that needed caregivers having the appropriate equipment know where to go and help the patient.

In one illustrative example, the patient support apparatus 10 is in wireless communication with waypoints and caregivers during the transportation process. The patient support apparatus includes a battery which provides power to the patient support apparatus during the move. A caregiver or patient may trigger an alarm during transportation immediately without having to find a stationary call unit or coupling the patient support apparatus to power and communication access points (e.g., a wall socket). As a result, an amount of time needed for additional caregivers with appropriate equipment to find the patient support apparatus and assist with the emergency is minimized.

Figure 1:
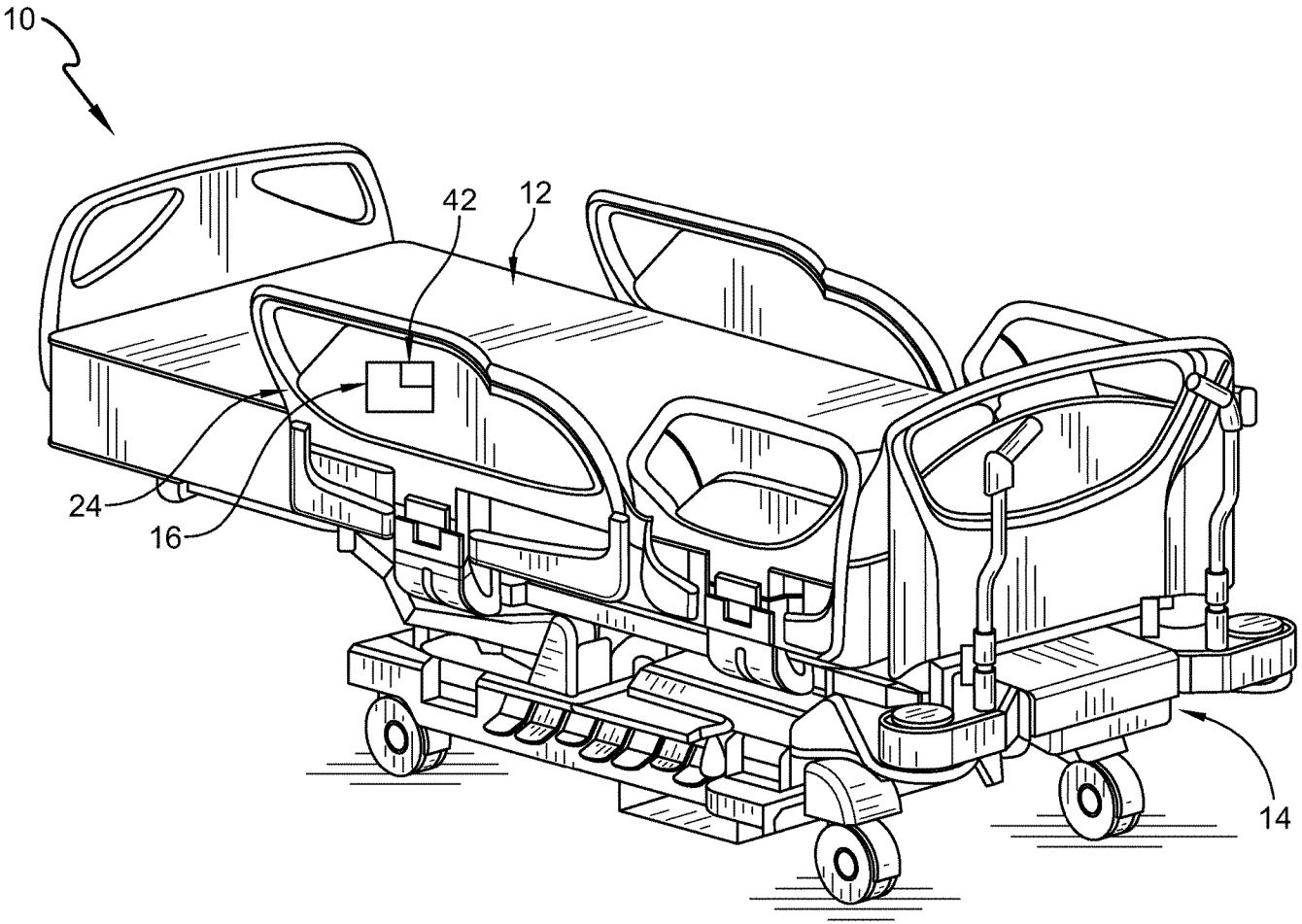
FIG. 1 is a perspective view of a patient support apparatus.

As shown in FIG. 1, the patient support apparatus 10 includes a patient support surface 12, a patient support structure 14, and a user interface 16. The patient support apparatus 10 is shown as a hospital bed. Those skilled in the art realize that the patient support apparatus 10 of the present disclosure may be implemented as a gurney, stretcher, surgical table, examination table, wheel chair, ambulance cot, hospital bed, or other suitable device known to the art. The patient support structure 14 rests on ground underlying the patient support surface and is movable relative to the ground. The patient support surface 12 is coupled to the patient support structure 14 and is adapted to support the patient resting on the patient support apparatus 12. The patient support apparatus 10 is configured to move throughout a healthcare facility, i.e. the patient support apparatus 10 is mobile and is not fixed in a location.

Figure 2:
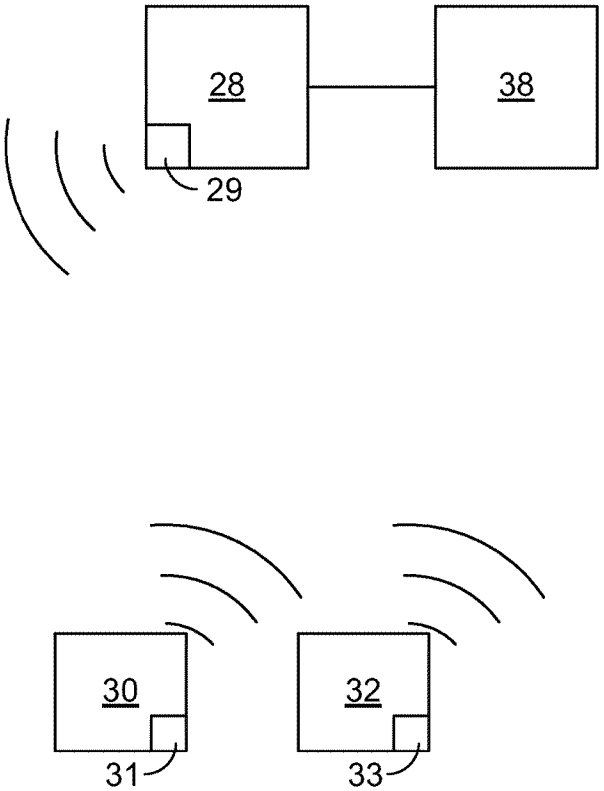
FIG. 2 is a schematic showing a logical architecture for an alarm and locating system for the patient support apparatus.
Figure 2:
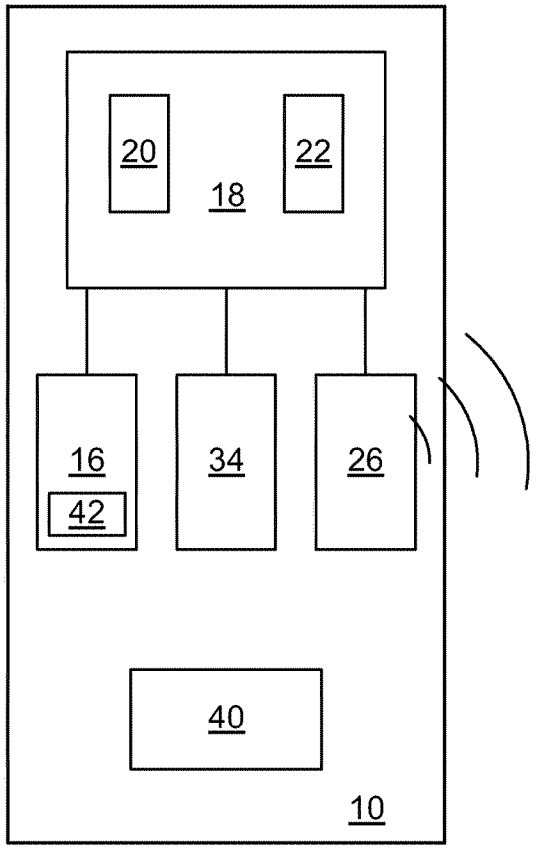

The user interface 16 is electrically coupled to a control circuitry 18 (shown in FIG. 2). The user interface 16 may provide information to the user. The user interface 16 also houses a user input 42 that allows the caregiver to alert other caregivers in the area of an emergent situation. In the illustrated embodiment the user interface 16 is located on the siderail 24 of the patient support apparatus 10. In other embodiments, the location of the user interface 16 may be housed in other sections of the patient support apparatus 10 or even placed on the outside of the patient support apparatus 10. Additionally, the user input 42 may not be included on the user interface 16. Rather, the user input 42 may be separate from the user interface 16 and located on another part of the patient support apparatus 10.

Referring to FIG. 2, the patient support apparatus 10 includes the control circuitry 18. The control circuitry 18 includes a memory 20 and a processor 22. The memory 20 holds instructions and data. The processor 22 operates as a central processing unit and is involved in the execution of instructions provided by the memory 20. Both the memory 20 and the processor 22 are located within the control circuitry 18. The control circuitry 18 is electrically coupled to the user interface 16. A location-detection system 34 is also in electrical communication with the control circuitry 18. The location-detection system 34 is operable to triangulate a location of the patient support apparatus 10 within the healthcare facility to determine a location ID of the patient support apparatus 10. For example, the location detection system 34 may determine the location of the patient support apparatus 10 with a global positioning system and/or through the transmission of signals to waypoints 30 positioned at fixed locations within the healthcare facility, to name two non-limiting examples.

A transceiver 26 is electrically coupled to the control circuitry 18. The transceiver 26 is in wireless communication with a server 28 including a remote computer 38, for example a remote computer at a nurse's station, and a transceiver 29 for receiving and sending signals. In one embodiment, the transceiver 26 may be in wireless communication with the server 28 via the waypoint 30 and/or a caregiver 32. The wireless communications may be a radio frequency (RF) signal. In other embodiments, the wireless communications may be an infrared (IR) signal, or any other suitable wireless signal that permits wireless communication. The transceiver 26 transmits a patient support apparatus ID that identifies the patient and the location ID to the server 28. In one embodiment, the patient support apparatus ID and the location ID are transmitted to the server 28 via the waypoint 30 and/or caregiver 32. Particularly, the waypoint 30 includes a transceiver 31 to receive and send signals. The caregiver 32 likewise includes a transceiver 33. For example, the transceiver 33 may be positioned on a caregiver badge or positioned within a remote communication device carried by the caregiver 32.

Once the patient support apparatus ID and the location ID are transmitted to the server 28, the location of the patient support apparatus 10 is displayed on the remote computer 38. The server 28 may then transmit this information to a caregiver 32 within the vicinity of the patient support apparatus 10 in the event of an emergent situation.

The user interface 16 includes the user input 42. The user input 42 is configured to be activated by a caregiver upon identification of an emergent situation, for example an emergent situation during transportation of the patient on the patient support apparatus 10. The patient support apparatus ID and location ID are transmitted via the transceiver 26 in the patient support apparatus 10. The patient support apparatus 10 transmits a signal to any one of the waypoint 30, a caregiver 32, the server 28, or a combination thereof. In order to avoid accidental activation of the user input 42, the user input 42 may be required to be held in the activated position for multiple seconds in order to assure the activation was purposeful. The length of time for which the user input 42 must be actively activated may range from 1-10 seconds, in one embodiment. Another embodiment of the user input 42 includes a cover that would prevent accidental activation. The cover may be located partially or wholly around the user input 42 and kept in place by a variation of a locking or latching device. In order to release the cover, in another embodiment, an apparatus may be provided near the user input 42 that allows a caregiver to scan their fingerprint prior to being allowed to activate the user input 42. The fingerprint activation would permit the release of the cover around the user input 42 or it would allow for the activation of the user input 42 without a cover. Other embodiments known to assist in preventing inadvertent activation of the user input may also be used.

In the illustrated embodiment, the patient support apparatus 10 also includes a battery 40. The battery 40 is configured to power the control circuitry 18 and other electrical components of the patient support apparatus 10. By powering the electrical components with the battery 40, the patient support apparatus 10 may be moved throughout the healthcare facility without losing power. That is, the patient support apparatus 10 maintains the ability to communicate with the sever 28 even when the patient support apparatus 10 is being transported throughout the healthcare facility. As such, in the event of an emergent situation during transportation of the patient support apparatus 10, the patient support apparatus 10 may be located within the healthcare facility so that emergency care may be provided to the patient.

Figure 3:
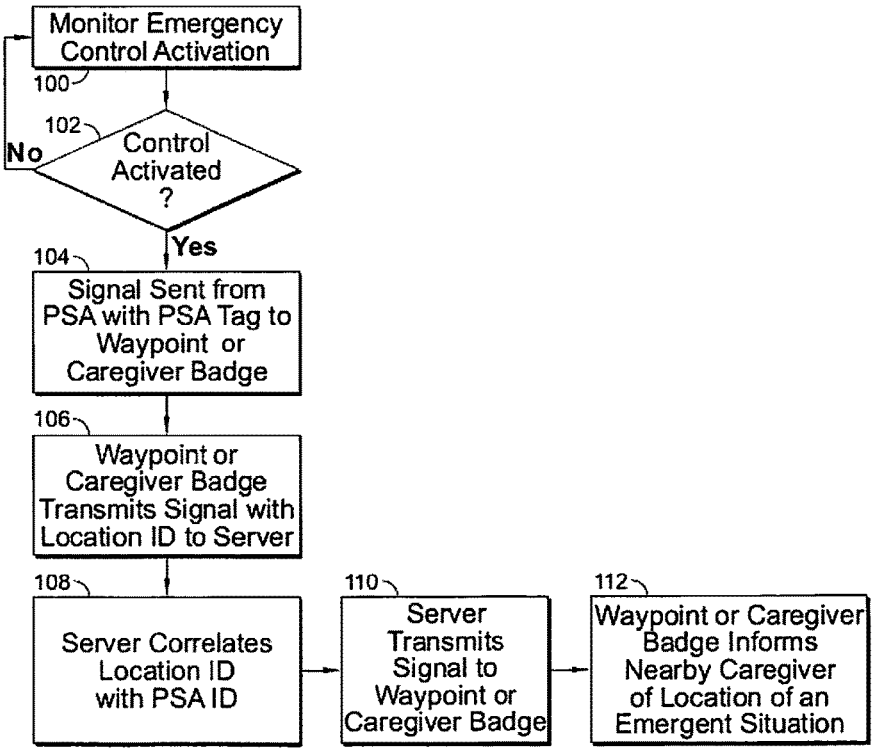
FIG. 3 is a flow diagram of an alarm and locating method of the communication system using a wireless signal.

As illustrated in FIG. 3, an embodiment for locating and providing assistance to an emergent situation at the patient support apparatus 10 is provided. In the illustrative embodiment, the user input 42 is continuously monitored by the control circuitry 18, at step 100. At step 102, the control circuitry 18 determines whether the user input 42 has been activated. If the user input 42 is activated, the patient support apparatus 10 transmits the patient support apparatus ID and the location ID to the waypoint 30 or caregiver 32, at step 104. At step 106, the waypoint 30 or caregiver 32 transmit the signal to the server 28. It should be noted that, in one embodiment, signals may be transmitted directly from the patient support apparatus 10 to the server 28. The server 28 then correlates the patient support apparatus ID with the location ID through an algorithm to triangulate a location of the patient support apparatus, at step 108. Once triangulation has occurred, at step 110, the server 28 sends a signal to a waypoint 30 and/or caregiver 32 within the vicinity of the emergent situation. At step 112, a caregiver 32 in the vicinity of the patient support apparatus 10 is alerted of the emergent situation so that assistance may be provided to the patient.

Figure 4:
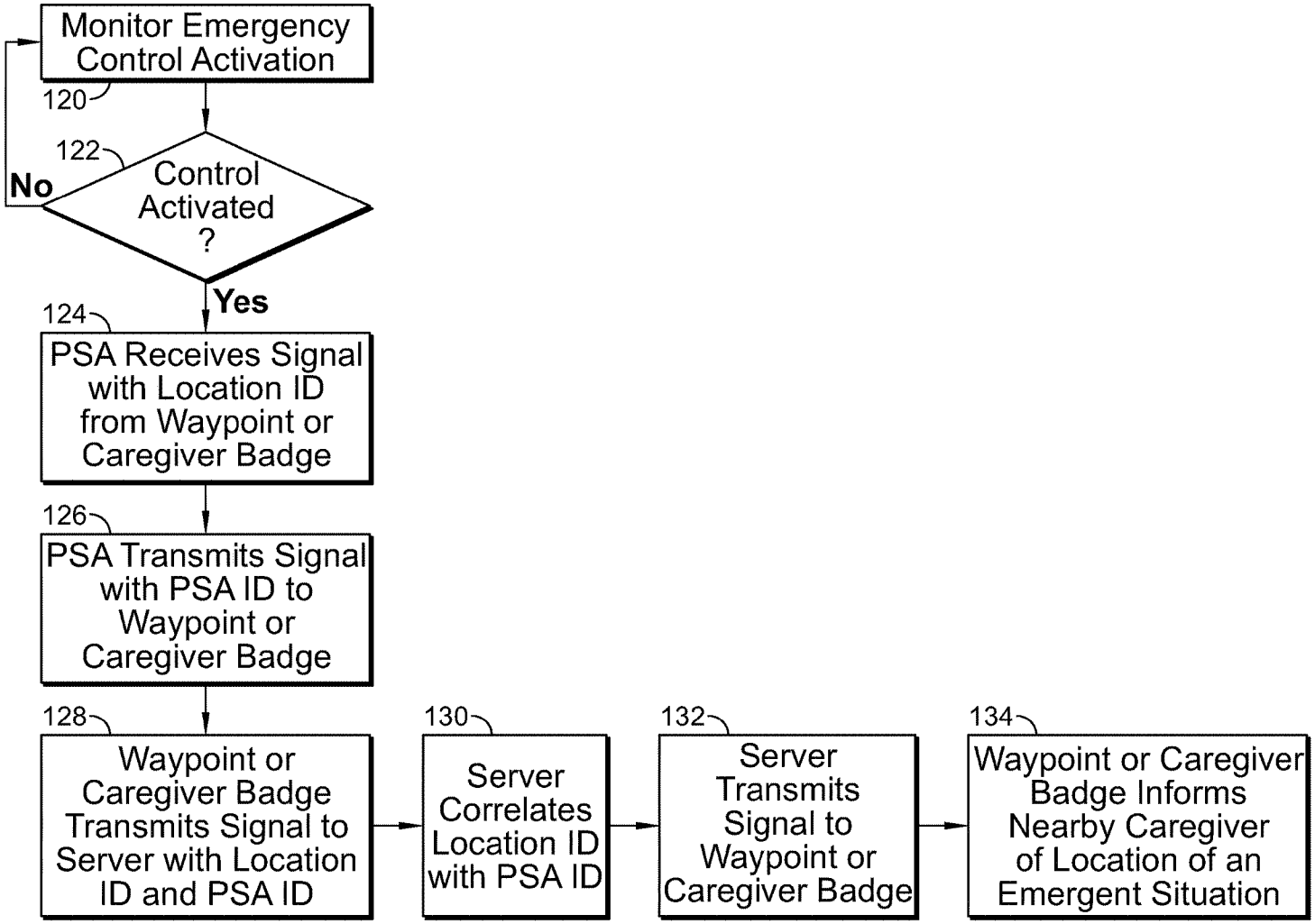
FIG. 4 is a flow diagram of an additional alarm and locating method of the communication system using a wireless signal.

FIG. 4 illustrates another embodiment for locating and providing assistance to an emergent situation at the patient support apparatus 10 is provided. In the illustrative embodiment, the user input 42 is continuously monitored by the control circuitry 18, at step 120. At step 122, the control circuitry 18 determines whether the user input 42 has been activated. If the user input 42 is activated, the patient support apparatus 10 receives a signal indicative of a location ID from a waypoint 30 or nearby caregiver 32, at step 124. The control circuitry 18 then transmits the location ID and the patient support apparatus ID to another waypoint 30 or caregiver 32, at step 126. At step 128, the waypoint 30 or caregiver 32 transmit the signal to the server 28. It should be noted that, in one embodiment, signals may be transmitted directly from the patient support apparatus 10 to the server 28. The server 28 then correlates the patient support apparatus ID with the location ID through an algorithm to triangulate a location of the patient support apparatus, at step 130. Once triangulation has occurred, at step 132, the server 28 sends a signal to a waypoint 30 and/or caregiver 32 within the vicinity of the emergent situation. At step 134, a caregiver 32 in the vicinity of the patient support apparatus 10 is alerted of the emergent situation so that assistance may be provided to the patient.

In one embodiment, alert data may be sent to the patient support apparatus 10, for example from the server 28 or the remote computer 38. The alert data may be displayed on the user interface 16. The alert data may include healthcare facility data, healthcare facility personnel data, or patient data. The healthcare facility data may include information regarding emergency services within the healthcare facility, for example the nearest location of an automated external defibrillator, the nearest oxygen source, available medications and their location, etc. Healthcare facility personnel data may include information regarding the nearest location of nurses and doctors, as well as doctor specialties. The patient data may include information relevant to patient health, for example allergies, medications, health conditions, etc.

Figure 5:
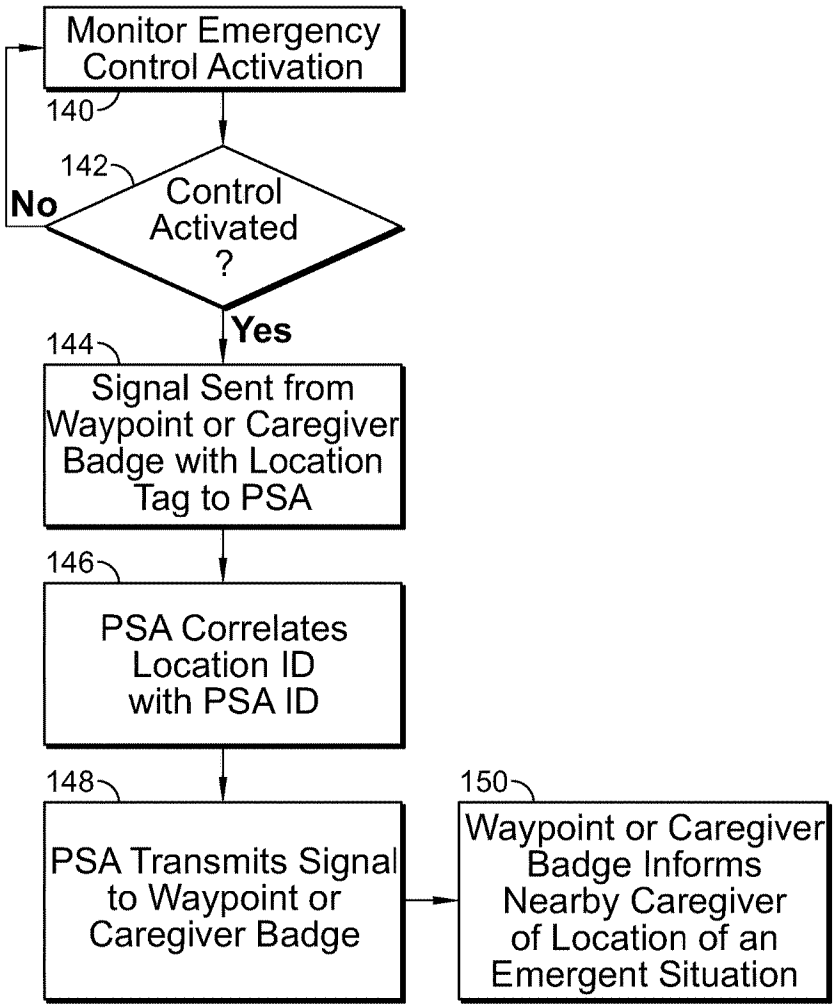
FIG. 5 is a flow diagram of an additional alarm and locating method of the communication system using a wireless signal.

FIG. 5 illustrates another embodiment for locating and providing assistance to an emergent situation at the patient support apparatus 10 is provided. In the illustrative embodiment, the user input 42 is continuously monitored by the control circuitry 18, at step 140. At step 142, the control circuitry 18 determines whether the user input 42 has been activated. If the user input 42 is activated, the patient support apparatus 10 receives a signal indicative of a location ID from a waypoint 30 or nearby caregiver 32, at step 144. The control circuitry 18 then correlates the patient support apparatus ID with the location ID through an algorithm to triangulate a location of the patient support apparatus, at step 146. Once triangulation has occurred, at step 148, the control circuitry 18 sends a signal to a waypoint 30 and/or caregiver 32 within the vicinity of the emergent situation. At step 150, a caregiver 32 in the vicinity of the patient support apparatus 10 is alerted of the emergent situation so that assistance may be provided to the patient.

Although this disclosure refers to specific embodiments, it will be understood by those skilled in the art that various changes in form and detail may be made without departing from the subject matter set forth in the accompanying claims.

The invention claimed is:

1. A patient-support status system comprising a patient support apparatus adapted to support a patient thereon, the patient support apparatus including control circuitry including memory storing the identity of the patient support apparatus, a user interface coupled to the control circuitry and monitoring for a user input associated with an emergent situation of the patient during transportation of the patient on the patient support apparatus, a location-detection system coupled to the control circuitry of the patient support apparatus, the location detection system communicating with location identifiers in a healthcare facility to provide a real-time location of the patient support apparatus as the patient support apparatus moves through the healthcare facility, and a transceiver coupled to the control circuitry, the transceiver communicating the patient support apparatus identity and the real-time location to a remote computer in response to receipt of the user input.

2. The patient-support status system of claim 1, further comprising a battery coupled to the patient support apparatus and configured to power control circuitry, the user interface, location detection system, and the transceiver.

3. The patient-support status system of claim 1, wherein the transceiver is further configured to communicate patient identification information to the remote computer.

4. The patient-support status system of claim 1, wherein the transceiver communicates through a radio frequency (RF) transmission.

5. The patient-support status system of claim 1, wherein the transceiver communicates through an infrared (IR) transmission.

6. The patient-support status system of claim 1, wherein the transceiver communicates through a wireless transmission.

7. The patient-support status system of claim 1, wherein the user interface is located on a siderail of the patient support apparatus.

8. The patient-support status system of claim 1, wherein the transceiver is configured to communicate the status and the location data to the remote computer via a waypoint.

9. The patient-support status system of claim 1, wherein the transceiver is configured to receive alert data from the remote computer, the alert data displayed on the user interface.

10. The patient-support status system of claim 9, wherein the alert data comprises at least one of healthcare facility data, healthcare facility personnel data, or patient data.

11. A method of communicating a location of a patient-support apparatus comprising receiving a user input associated with an emergent situation of a patient supported on the patient support apparatus at a user interface coupled to the patient support apparatus and moving therewith, providing real-time location data associated with a location of the patient support apparatus in the healthcare facility at the time of the emergent situation with a location-detection system having multiple location identifiers located throughout the healthcare facility, and communicating, with a transceiver coupled to the patient support apparatus, the emergent situation and the location data to a remote computer in response to receipt of the user input.

12. The method of claim 11, further comprising powering the user interface, location detection system, and transceiver with a battery coupled to the patient support apparatus.

13. The method of claim 11, further comprising communicating patient identification information to the remote computer.

14. The method of claim 11, further comprising communicating through a radio frequency (RF) transmission.

15. The method of claim 11, further comprising communicating through an infrared (IR) transmission.

16. The method of claim 11, further comprising communicating through a wireless transmission.

17. The method of claim 11, further comprising communicating the status and the location data to the remote computer via a waypoint.

18. The method of claim 11, further comprising receiving, at the transceiver, alert data from the remote computer.

19. The method of claim 11, further comprising displaying the alert data on the user interface.

20. The method of claim 19, wherein the alert data comprises at least one of healthcare facility data, healthcare facility personnel data, or patient data.

21. A healthcare facility location communication system comprising a remote computer located in a healthcare facility for monitoring a patient status, and a patient support apparatus adapted to support the patient thereon, the patient support apparatus comprising a user interface to receive a user input associated with an emergent situation of the patient, a location-detection system configured to provide real-time location data associated with a location of the patient support apparatus in the healthcare facility at the time of the emergent situation, and a transceiver configured to communicate the status and the location data to a remote computer in response to receipt of the user input.

22. The system of claim 21, wherein the a patient support apparatus further comprises a battery coupled to the patient support apparatus and configured to power the user interface, location detection system, and transceiver.

23. The system of claim 21, wherein the transceiver is further configured to communicate patient identification information to the remote computer.

24. The system of claim 21, wherein the transceiver communicates through a radio frequency (RF) transmission.

25. The system of claim 21, wherein the transceiver communicates through an infrared (IR) transmission.

26. The system of claim 21, wherein the transceiver communicates through a wireless transmission.

27. The system of claim 21, wherein the user interface is located on a siderail of the patient support apparatus.

28. The system of claim 21, further comprising a waypoint, wherein the transceiver is configured to communicate the status and the location data to the remote computer via the waypoint.

29. The system of claim 21, wherein the transceiver is configured to receive alert data from the remote computer, the alert data displayed on the user interface.

30. The system of claim 29, wherein the alert data comprises at least one of healthcare facility data, healthcare facility personnel data, or patient data.

* * * * *